US007832705B2

(12) United States Patent
Spencer et al.

(10) Patent No.: US 7,832,705 B2
(45) Date of Patent: Nov. 16, 2010

(54) GRADE BRACKET FOR USE IN CONCRETE FORM SYSTEM

(76) Inventors: Derrel L. Spencer, 1362 W. 1750 North, Lehi, UT (US) 84043; Kurtis Jones, 13739 S. 6315 West, Herriman, UT (US) 84065

( * ) Notice: Subject to any disclaimer, the term of this patent is extended or adjusted under 35 U.S.C. 154(b) by 1122 days.

(21) Appl. No.: 11/466,071

(22) Filed: Aug. 21, 2006

(65) Prior Publication Data

US 2007/0045491 A1 Mar. 1, 2007

Related U.S. Application Data

(60) Provisional application No. 60/710,440, filed on Aug. 23, 2005.

(51) Int. Cl.
*E04G 17/00* (2006.01)

(52) U.S. Cl. ..... 249/219.1; 249/3

(58) Field of Classification Search ..... 249/2, 249/3, 208, 219.1; 248/297.1
See application file for complete search history.

(56) References Cited

U.S. PATENT DOCUMENTS 2,572,732 A 10/1951 Keklen et al.
4,846,437 A 7/1989 Fitzgerald
5,076,536 A 12/1991 Fitzgerald
5,096,155 A 3/1992 Fitzgerald
5,156,753 A 10/1992 Speidel
5,205,942 A 4/1993 Fitzgerald

*Primary Examiner*—Michael Safavi
(74) *Attorney, Agent, or Firm*—Morris O'Bryant Compagni

(57) ABSTRACT

A grade bracket for use with concrete form systems is disclosed. In one embodiment, the grade bracket forms part of a concrete form system that includes a plurality of form components, including straight forms, curved radius forms, and skin panels for interconnecting form components. The form components are assembled atop a ground surface and are configured to define a volume for containing poured concrete. Grade brackets for supporting the form components at a desired grade above the ground are used. Each grade bracket includes a body, a form support member, and a grade knob. The form support member attaches to the body and includes a bracket portion that supports the form component. The grade knob includes an eye-bolt. A stake secured in the ground is selectively engaged by the eye-bolt of the grade knob such that the grade bracket is maintained at a desired position on the stake.

8 Claims, 10 Drawing Sheets

GRADE BRACKET FOR USE IN CONCRETE FORM SYSTEM

CROSS-REFERENCE TO RELATED APPLICATIONS

This application claims the benefit of U.S. Provisional Patent Application No. 60/710,440, filed Aug. 23, 2005, and entitled "Grade Bracket for Use in Concrete Form System," which is incorporated herein by reference in its entirety.

BACKGROUND

1. Technology Field

The present invention generally relates to concrete form systems. In particular, the present invention relates to a grade bracket that is useful for setting and maintaining portions of a concrete form system at a desired grade level.

2. Related Technology

Concrete flatwork structures are routinely poured all over the world. Concrete flatwork—including concrete pads, sidewalks, driveways, roadways, etc.—provides a solid, secure surface for use or on which to build a home or other building. In the past, conventional concrete flatwork was often constructed by nailing dimensional wood products, such as 2×4 lumber, or other materials into a form with a desired shape on a ground surface, then pouring concrete into the volume created by the lumber.

After the concrete is cured, the lumber is separated from the concrete, often using a hammer. Unfortunately, this often results in cracking and splintering of the lumber, thus making it unusable for creating new flatwork forms. This not only wastes material, but can be a safety hazard because splintered wood can cause unintended injury to workers.

A related challenge involves the manner in which form components, such as the 2×4 lumber pieces, are supported when positioned to comprise a portion of the form. With any solution to the above challenges encountered with traditional lumber form components comes the related issue as to how such form components are to be supported at a desired grade above the ground surface in a manner that allows the form to precisely define the area to be covered by concrete.

In light of the above discussion, a need exists for a concrete system that eliminates the above-mentioned disadvantages and problems. In addition, a system for supporting form components that solve the above issues is also desired such that the form components can be accurately and easily positioned at a desired grade prior to pouring concrete into the resultant form.

BRIEF SUMMARY

The present invention has been developed in response to the above and other needs in the art. Briefly summarized, embodiments of the present invention are directed to a grade bracket for use with concrete form systems. In one embodiment, the grade bracket forms part of a concrete form system that includes a plurality of form components, including straight forms, curved radius forms, and skin panels for interconnecting form components. The form components are assembled atop a ground surface and are configured to define a volume for containing poured concrete.

Grade brackets for supporting the form components at a desired grade above the ground are used. Each grade bracket includes a body, a form support member, and a grade knob. The form support member attaches to the body and includes a bracket portion that supports the form component. The grade knob includes an eye-bolt. A stake secured in the ground is selectively engaged by the eye-bolt of the grade knob such that the grade bracket is maintained at a desired position on the stake.

In another embodiment, a grade bracket for supportably retaining a form component in a concrete form system is disclosed. The grade bracket here includes a body, a form support member, and an adjustable means for securing the body to a secured structure, such as a stake. The form support member is selectively extendable from the body, which is a hollow, four-sided, trapezoidal body. The form support member is configured to support the form component in a desired grade position. The adjustable means for securing the body to the stake can be a grade knob that is operably attached to the body. The grade knob includes a handle, an eye-bolt threadably engaged with the handle, and a washer interposed between the handle and a portion of the body. The eye-bolt is configured such that it frictionally engages the stake that passes therethrough, thereby securing the grade bracket in a desired position.

In yet another embodiment, a grade bracket for supporting a form component of a concrete form system is disclosed. The grade bracket comprises a body defining a top surface, a bottom surface, a first side surface, and a second side surface. At least one hole is defined in each of the top and bottom surfaces. The grade bracket further includes a form support member that includes a bracket portion configured to engage the form component. The body includes two tabs that slidably retain the form support member with respect to the body such that the bracket portion is selectively movable with respect to the body. The form support member also includes a hole defined therein. Finally, a grade knob is also included and comprises a handle that threadably engages with an eye-bolt. The eye-bolt can be aligned with the holes of the bracket portion and top and bottom body surfaces such that a stake can pass through the eye-bolt and the holes of the bracket portion and top and bottom surfaces. The grade knob selectively engages the stake such that the grade bracket is maintained at a desired position with respect to the stake and such that the form is maintained at a desired grade.

These and other features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof that are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF SELECTED EMBODIMENTS

Figure 1:
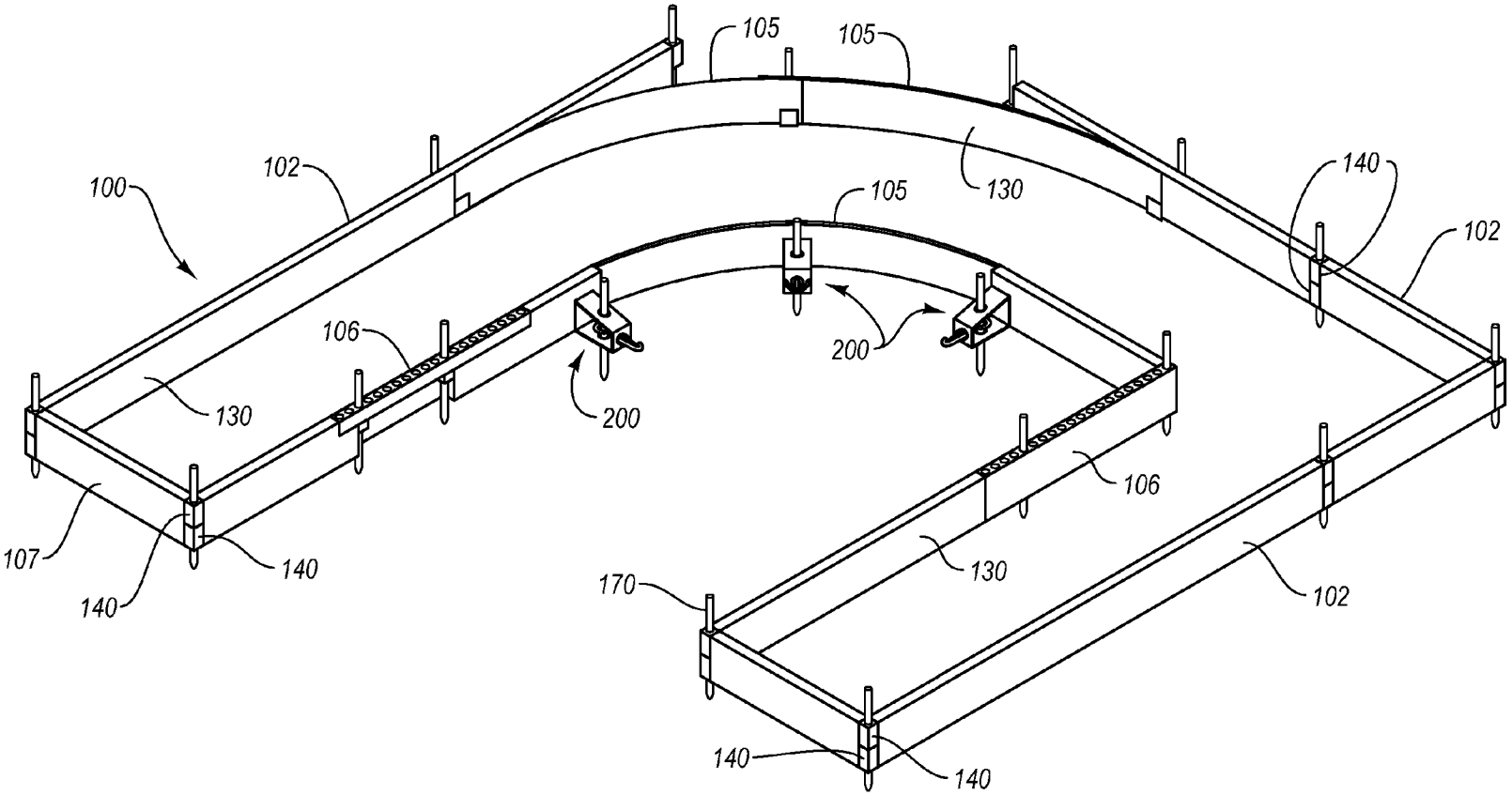
FIG. 1 is a perspective view of a concrete forming system, including a grade bracket configured according to one embodiment of the present invention.

Reference will now be made to figures wherein like structures will be provided with like reference designations. It is understood that the drawings are diagrammatic and schematic representations of exemplary embodiments of the invention, and are not limiting of the present invention nor are they necessarily drawn to scale.

FIGS. 1-10 depict various features of embodiments of the present invention, which are generally directed to a grade bracket for use with concrete forming systems. The grade bracket disclosed herein enables quick and accurate adjustments to the grade of a form component of the concrete forming system to be made. This in turn ensures that the resultant form is properly oriented with respect to the ground surface on which the forming system is placed, ensuring that a proper concrete pour results.

The system 100 includes various form components, such as a plurality of straight forms of any suitable length, e.g., 102 (long) and 107 (short), which cooperate with other illustrated components on a surface, such as the ground, to define a space in which concrete or other suitable flowable product can be poured and maintained in a predetermined desired shape until hardened to the desired shape. In addition, radius form components 105 can also be included to assist in defining rounded perimeter portions of the predetermined desired space. Skin panels 106 are employed to bridge gaps between adjacent forms 102/105 when the gap is smaller than what can be filled by a standard sized form.

The various form components, i.e., forms/panels 102, 105, and 106, together bound a predetermined desired volume and define an inside surface 130 that forms the perimeter of the predetermined desired volume for the concrete or flowable material that is to be inserted therein. Mating of adjacent straight forms 102 is achieved via the use of interlocking end brackets 140 included at ends of each of the forms 102. A stake 170 is driven through a center cylinder defined by the interlocking end brackets 140 in order to secure the forms in place with respect to one another, as well as to maintain the system 100 in place on the surface on which the system 100 is placed.

The system 100 represents an improvement over known forming systems in that its forms and skin panels are formed of a durable material, such as metal, which allows their continued use without significant degradation. Also, various perimeter shapes are easily achieved by the present forming system. Further, the forming system shown in FIG. 1 is fully adjustable so that perimeters of a variety of lengths can be accommodated using the illustrated form components. Further details regarding the system 100 can be found in copending U.S. application Ser. No. 11/037,878, filed Jan. 17, 2005, and entitled "CONCRETE FORM SYSTEM WITH ADJUSTABLE KEYWAY BRACKET SYSTEM", which is incorporated herein by reference in its entirety.

Figure 2:
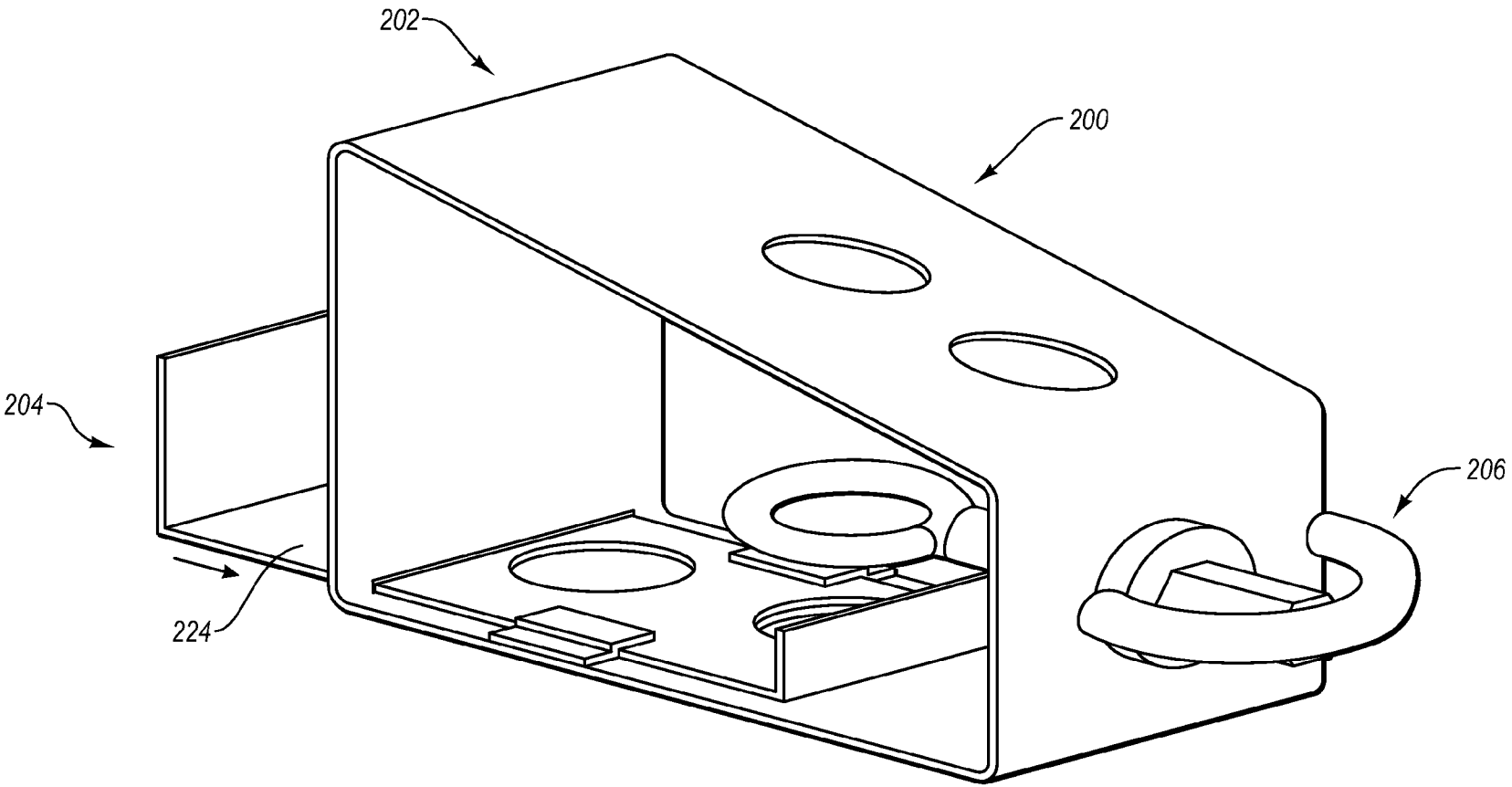
FIG. 2 is a perspective view of a grade bracket configured in accordance with one embodiment.

Reference is now made to FIG. 2, which depicts various details of one embodiment of a grade bracket, generally designated at 200, for use with the system 100 of FIG. 1, according to one embodiment. As shown, the grade bracket 200 includes various components, namely, a body 202, a form support member 204, and a grade knob 206. These components cooperate to form the grade bracket 200 and to enable its use in maintaining the forms 102, 105, and/or skin panels 106 at a desired grade, or level, above the surface on which the system 100 is positioned, as will be explained. Each component of the grade bracket 200 is further described below.

Notwithstanding the discussion contained herein, the grade brackets of the present invention can be employed in forming systems that differ in various details from that shown and described herein. For instance, though the system shown in FIG. 1 employs forms and skin panels that differ substantially from standard, known form systems, the grade bracket of embodiments of the present invention can also be used with such standard systems, including those employing lumber for form components.

Figure 3:
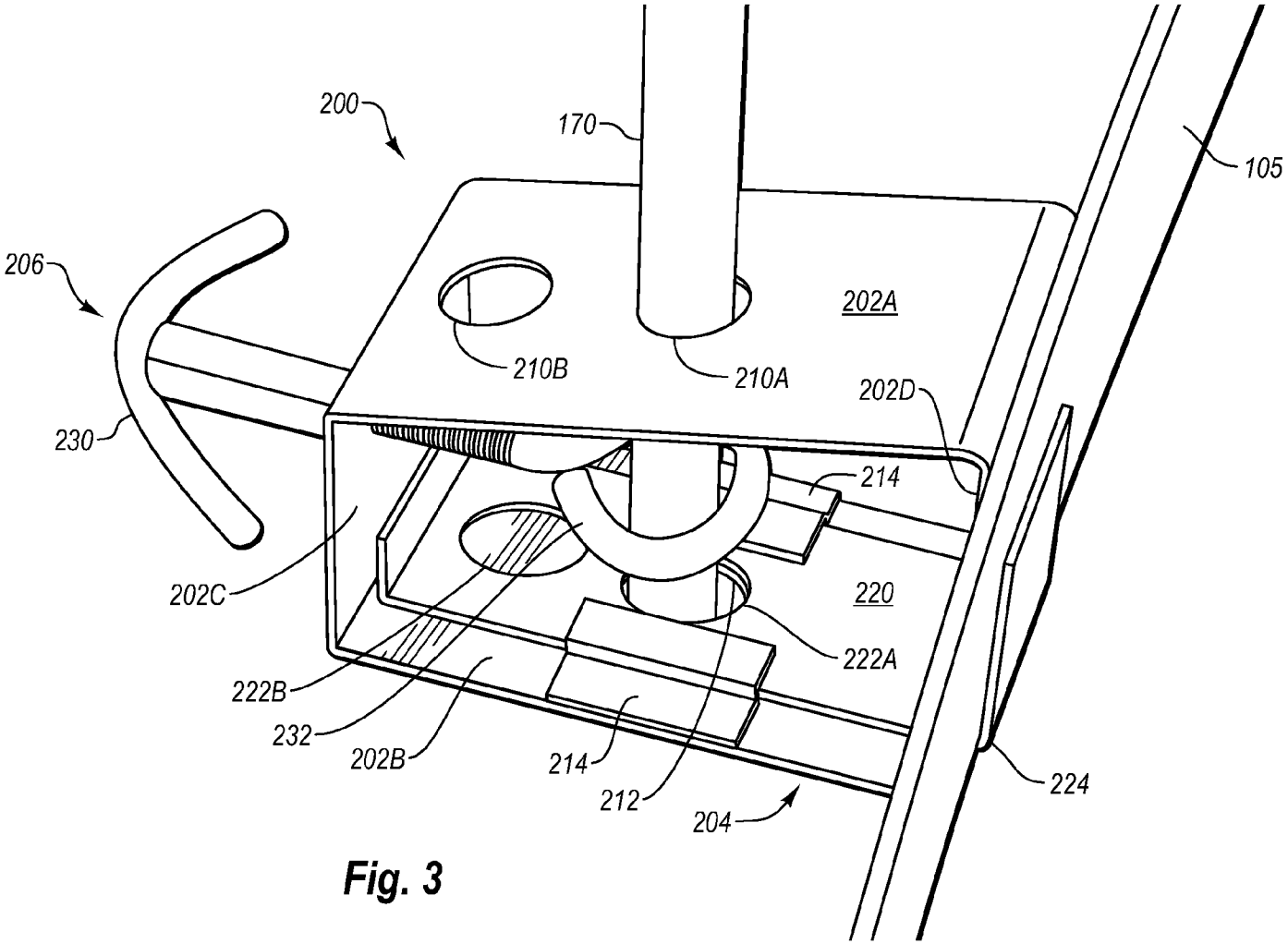
FIG. 3 is a perspective view of an embodiment of a grade bracket being employed in connection with a concrete forming system.
Figure 4:
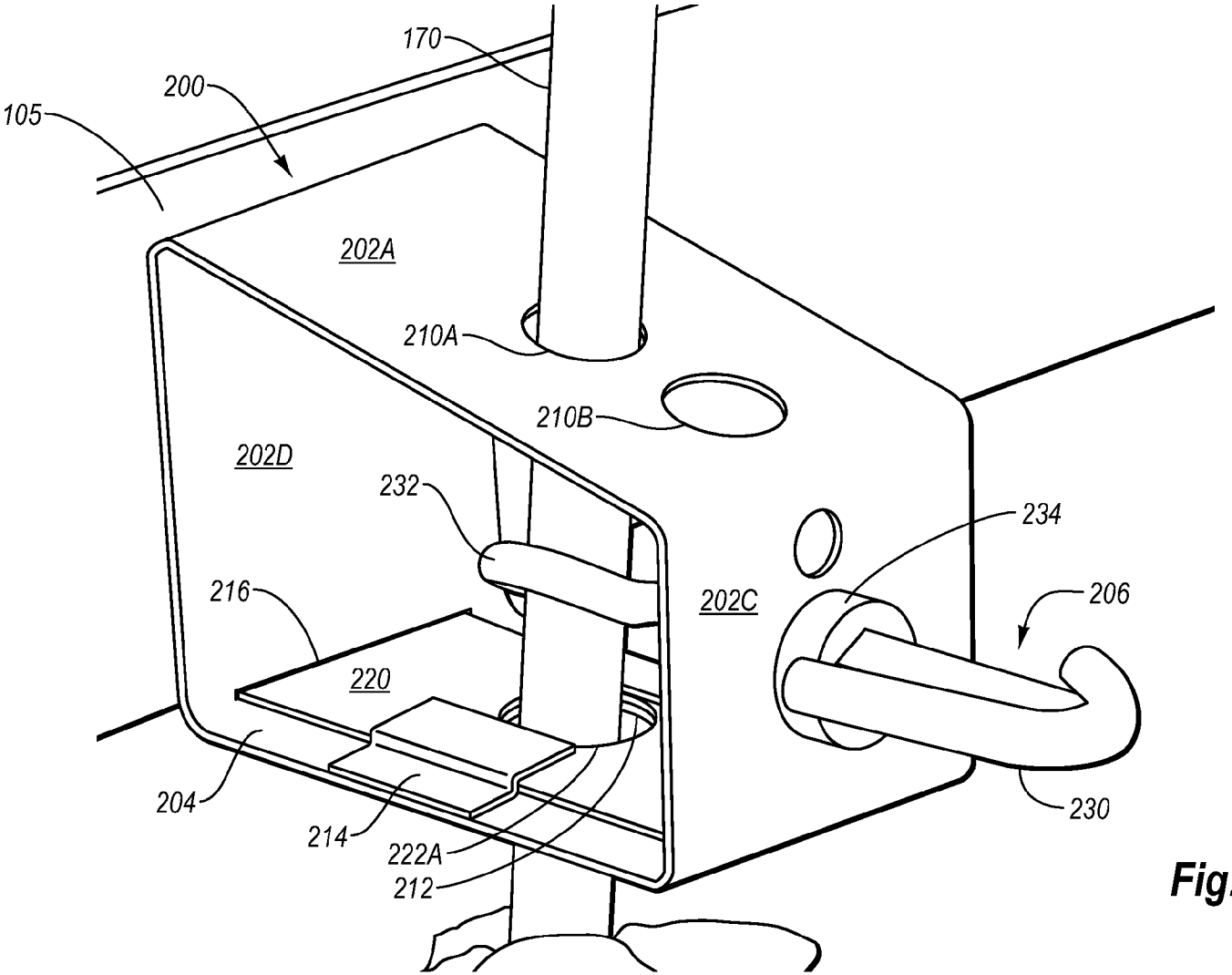
FIG. 4 is another perspective view of an embodiment of a grade bracket being employed in connection with a concrete forming system.

Together with FIG. 2, reference is now made to FIGS. 3 and 4 in describing the various components of the grade bracket 200. The body 202 of the grade bracket 200 includes, as viewed from the orientation of FIGS. 3 and 4, a top portion 202A, a bottom portion 202B, first side portion 202C and second side portion 202D. These body portions can be integrally formed from a single piece of suitable material, such as metal, or from multiple pieces bonded together in a suitable manner. So configured, a longitudinal cross section of the body 202 defines a trapezoidal shape, though other body shape configurations are also possible in alternative embodiments. For instance, the second side portion 202D in one embodiment could be merely a side segment, extending down from the top portion 202A a certain distance while not extending and attaching to the bottom portion 202B of the body 202, or alternatively, extending up from the bottom portion 202B of the body 202 while not attaching to the top portion 202A.

The top portion 202A of the grade bracket body 202 includes one or more holes. In detail, FIGS. 3 and 4 show the top portion 202A as including a first hole 210A and a second hole 210B. The bottom portion 202B also includes a hole 212. These holes cooperate with first and second holes 222A and 222B defined in the form support member 204 to receive a corresponding stake 170 therethrough in connection with operation of the grade bracket 200, as will be described.

The grade bracket bottom portion 202B includes two tabs 214 that are sized and configured to slidably engage with the form support member 204 to enable the latter component to move relative to the body 202 in order to facilitate operation of the grade bracket 200. Also, a slit 216 is defined near the intersection of the bottom portion 202B and the second side portion 202D to enable passage of the form support member 204 through the second side portion 202D.

The form support member 204 includes a slide portion 220 and an L-shaped bracket portion 224 (FIG. 2) that are defined as portions of an integral piece of material formed from a suitable material, such as metal. As mentioned, the slide portion 220 defines the first and second holes 222A and 222B for receiving the stake 170 therethrough during use of grade bracket 200. The slide portion 220 is positioned with respect to the bottom body portion 202B so as to be received in the tabs 214 thereof. This enables the form support member 204 to slidably move with respect to the body 202 during operation of the grade bracket 200, as is described further below.

Movement of the form support member 204 in the above manner causes corresponding movement of the bracket portion 224 of the form support member with respect to the second side portion 202D. As mentioned, a portion of the bracket portion 224 can be selectively extended beyond the second side portion 202D via the slit 216. Selectable extension of the bracket portion 224 in this manner enables the "L" shape of the bracket portion 224 to engage and support a portion of a corresponding form component of the concrete forming system 100, including one of the straight forms 102, radius forms 105, or skin panels 106 along a bottom surface thereof, as shown in FIG. 1. The bracket portion 224 is further selectively slidable with respect to the grade bracket body 202 to accommodate varying form component/skin panel thicknesses, or varying placement distances of the grade bracket 200 with respect to the corresponding form/panel, 102, 105, 106. For example, FIG. 2 shows the bracket portion 224 in a relatively largely extended position with respect to the grade bracket body 202. This position may be suitable for accommodating thick form components or skin panels 106, etc. In contrast, FIG. 3 shows the bracket portion 224 of the form support member 204 in a relatively less extended position with respect to the grade bracket body 202. This position is suitable for accommodating relatively thin form components, such as the straight form 102 shown in FIGS. 3 and 4. In addition, various other grades of extension can be achieved, according to the particular configuration of the form support member 204 and as needed for a particular application.

Regardless of the amount of its extension, the form support member bracket portion 224 should be configured such that a form component that is supported by the bracket portion 224 is snugly held between the inner surface of the bracket portion 224 and the second side portion 202D of the body 202. This configuration ensures that the form component, such as the straight form 102, radius form 105, or skin panel 106, is properly supported at the desired level, or grade, above the ground surface and at the proper orientation. In other embodiments, it is possible to correspondingly slant the second side portion 202D and bracket portion 224 so as to support form components at an angle, if desired. Also, in one embodiment, the form support member 204 can be fixedly attached to the grade bracket body 202 such that a constant, non-changeable spacing is achieved between the bracket portion 224 and the second side portion 202D. This configuration could be employed where the forms 102 105 to be supported are of equal thickness such that adjustment of the form support member 204 is unnecessary.

The grade knob 206 of the grade bracket 200 is employed to engage the stake 170 in order to maintain the grade bracket 200 at a desired level above the surface on which the system 100 is positioned, which in turn enables the grade bracket 200 to assist in maintaining forms/panels 102, 105, 106 of the system 100 at a desired grade. The grade knob 206 of the illustrated embodiment is a three-piece assembly that includes a handle 230 operably attached to an eye-bolt 232, and a washer 234. The grade knob 206 extends through the first side portion 202C of the body 202 such that the handle 230 and washer 234 are positioned on an exterior portion of the first side portion 202C. The eye-bolt 232 is threaded so as to threadably engage corresponding threads formed in the passage through the first side portion 202C. This enables the eye portion of the eye-bolt 232 to be selectively moved relative the first side portion 202C by rotating the handle 230. The washer 234 in one embodiment can be a compression washer to maintain adequate resistive force on the eye-bolt 232 to prevent undesired rotation of the grade knob 206 when engaged with the stake 170 and to prevent deformation of the first side portion 202C when the grade knob 206 is tightened. Also, the handle 230 can include one of a variety of configurations preferably suitable for hand use.

So configured, the grade knob 206 serves as one example of an adjustable means for securing the body 202 of the grade bracket 200 to a reference structure, such as the stake 170. However, it should be appreciated that various other configurations could serve as the means for securing. For instance, instead of a threaded bolt, a spring-biased bolt could be used. Or, instead of an eye-bolt 232, a bolt having a friction lever that can be selectively actuated to frictionally engage a portion of the stake 170 can be used. Further, the reference structure in the illustrated embodiment is a stake 170. However, in other embodiments, the reference structure can be another object, such as a wall adjoining the form perimeter. In such a case, the means for securing the body is adapted to engage the object in such a way as to secure the grade bracket 200 for use in maintaining the grade of the form component it supports.

In addition, the eye-bolt 232 is round, as shown in FIGS. 3 and 4. However, in other embodiments, the eye-bolt 232 could define other shapes, such as square, hexagon, etc. Use of such shaped eye-bolts 232 could be advantageous in allowing relatively more engagement between the eye-bolt 232 and the stake 170 during use of the grade bracket 200. Similarly, the holes 210A-B, 212, and 222A-B defined in the grade bracket body 202 could also define other shapes, including square, hexagon, etc., if desired. Correspondingly, the cross sectional shape of the stake 170 could be other than round, if desired, to allow for corresponding engagement with the holes 210A-B, 212, and 222A-B of the grade bracket body 202. In light of this discussion, therefore, it should be realized that the present invention should not be construed as to be limited to those embodiments explicitly disclosed herein, but that these embodiments are simply illustrative of the broader principles encompassed by the present invention.

Operation of the grade bracket 200 configured to the embodiment illustrated in FIGS. 3 and 4 proceeds as follows. Initial positioning of the grade bracket 200 with respect to the form component to be supported in the system 100 is performed. This includes positioning the bracket portion 224 of the form support member 204 under a corresponding form component such as the straight form 102, radius form 105, or other suitable component to be supported. Sliding adjustment of the form support member 204, via the sliding engagement of its slide portion 220 with the bottom portion 202B of the grade bracket body 202, may be necessary in order to ensure a snug fit of the form component between the bracket portion 224 and the second side portion 202D.

Sliding adjustment of the form support member 204 with respect to the grade bracket body 202 further includes aligning the bottom hole 212 of the body 202 with one of the holes 222A/222B of the form support member slide portion 220 such that the stake 170 can be received therethrough. The choice of which of the holes 222 is to be used is dependent upon the thickness of the form component to be supported: the hole 222A is aligned with the bottom body hole 212 when the form component to be supported is relatively thin, as shown in FIGS. 3 and 4, for example, while the hole 222B is aligned with the bottom body hole 212 when the form component is thick, a configuration of which is generally shown in FIG. 2.

In some cases, the choice of which of the holes 222A/B to align with the bottom hole 212 can also depend on the spacing of the body 202 with respect to the form/panel to be supported, and so adjusting the proximity of the body 202 orthogonally with respect to the form/panel surface can also be employed in properly aligning the various holes.

When one of the holes 222A/222B and the bottom hole 212 are aligned, alignment with one or both of the top holes 210A/210B is also achieved. Typically, alignment with the top hole 210A is preferred, as this hole allows for substantially vertical passage of the stake 170 through the grade bracket 200 before entry into the ground. However, slanted passage of the stake 170 through the second top hole 210B before passage through one of the holes 222A/B and bottom hole 212 is also possible, should circumstances warrant. Note that relative spacing of both the holes 210A and 210-B to one another and the holes 222A and 222B to one another can be varied in the manufacture of the grade bracket 200 so as to produce a desired spacing between the bracket portion 224 of the form support member 204 and the second side portion 202D of the body 202.

Once the bracket body 202 and form support member 204 are properly positioned such that the holes 212 and 222A or 222B are aligned, the eye-bolt 232 is moved as needed in order to align it with the above holes. The stake 170 is then passed through one of the top holes 210A/210B, the eye-bolt 232, and the aligned holes 212 and 220A/B before being securely driven into the ground or other surface.

This substantially restricts lateral and orthogonal movement of the grade bracket 200, while preserving selective vertical movement thereof. The grade bracket 200, with its form support member 204 being engaged with the corresponding form component, can then be selectively moved vertically up or down the stake 170 until the form/panel is positioned at the proper grade above the surface on which the system 100 is positioned.

While maintaining the grade bracket 200 at this level, the grade knob 206 is then rotated in order to tighten the engagement of the looped eye portion of the eye-bolt 232 with the portion of the stake 170 passing therethrough. Note again that in other embodiments, the eye-bolt 232 can be replaced by another mechanism by which stake engagement can be realized. Sufficient tightening of the grade knob 206 is achieved such that the grade bracket 200 is fixed in place on the stake 170. Of course, the previous fixation of the stake position in the ground is necessary for maintaining the form/panel at desired grade. Engagement of the eye-bolt 232 with the stake 170 also causes the form support member 204 to be secured in place such that the bracket portion 224 maintains the form component sandwiched between the bracket portion 224 and the second side portion 202D. The compression washer 234 in one embodiment can assist the maintenance of sufficient tension between the eye-bolt 232 and the stake 170.

Figure 5:
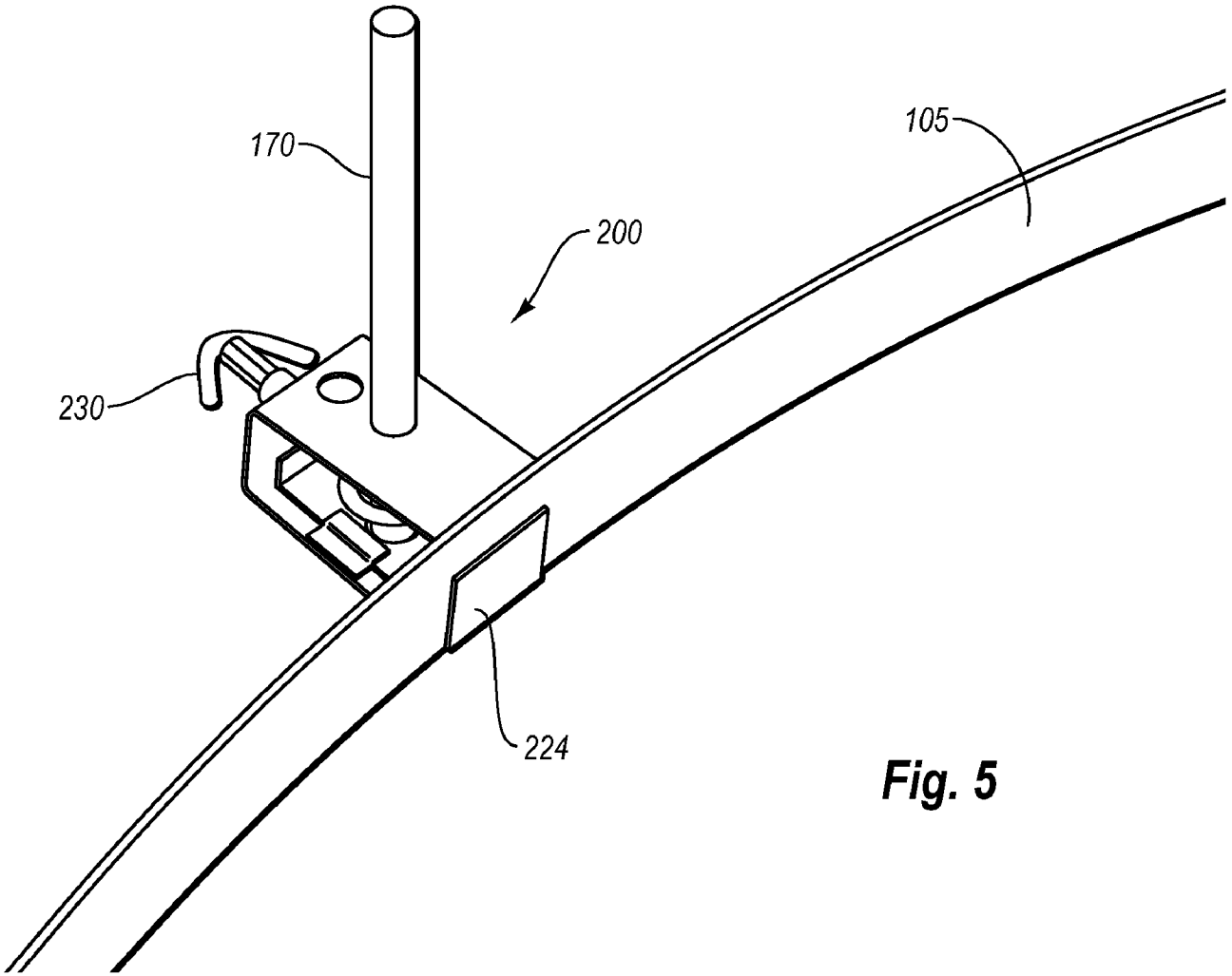
FIG. 5 is a perspective view of an embodiment of a grade bracket being employed in connection with an outside curve in a concrete forming system.
Figure 6:
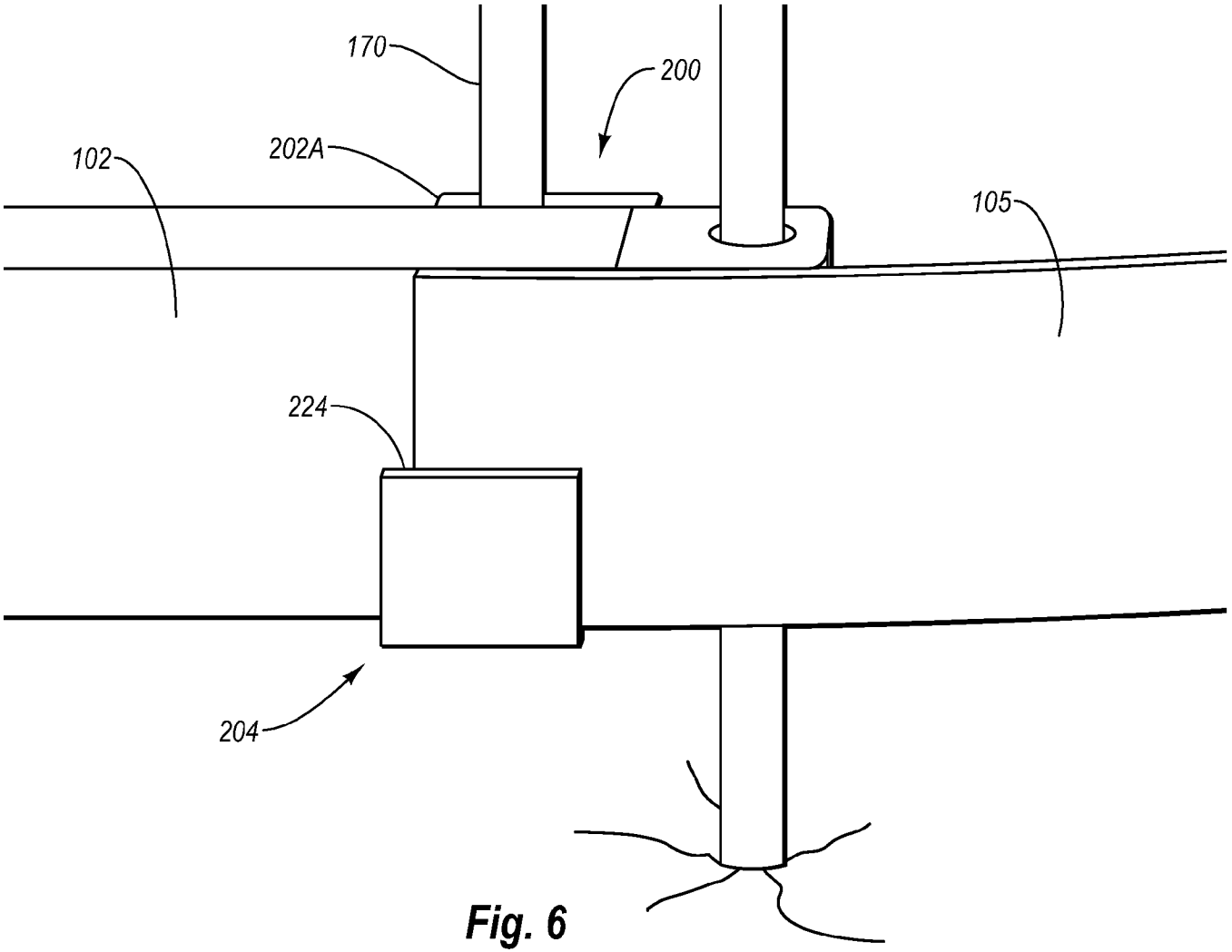
FIG. 6 is a perspective view of an embodiment of a grade bracket being employed at a joint of two forms in a concrete forming system.

FIGS. 5-6 show grade brackets 200 employed in maintaining forms 102, 105 at a desired grade. As depicted, the grade bracket 200 can be used to support linear or non-linear form components. In particular, FIG. 5 shows the grade bracket 200 supporting a radius form 105, while FIG. 6 shows a grade bracket 200 supporting at grade a junction of a relatively thick straight form 102 and a thin radius form 105.

Note that the present grade bracket 200 can also be employed in an "upside-down" configuration, wherein the grade bracket 200 is rotated 180 degrees, about an imaginary axis extending through the length of the grade knob 206, from the bracket orientation shown in FIG. 4. So rotated, a stake 170 can then be passed, in order of entry, through the holes 212 and 222A, the eye-bolt 232, and finally through the hole 210A. In this inverted orientation, the bracket portion 224 of the form support member 204 engages a top portion of the form component, such as the radius form 105, so as to stabilize the form component. Note that this upside-down configuration of the grade bracket 200 is preferably used with grade brackets 200 engaged with the form component as shown in FIGS. 3 and 4. Thus, the grade brackets 200 oriented as shown in FIGS. 3 and 4 are employed to maintain the form component at a desired grade, while the upside-down grade brackets 200 are employed primarily to stabilize the form component.

In a variation of the above upside-down configuration, the stake 170 can be alternatively driven in an angled direction through the hole 210B instead of through the hole 210A of the grade bracket 200 while in the upside-down position. Orientation of the stake 170 in this manner allows its entry into the ground at a point relatively farther away from the area to be poured with concrete, thereby avoiding any complications with disturbing the ground near the area to be poured.

Figure 7:
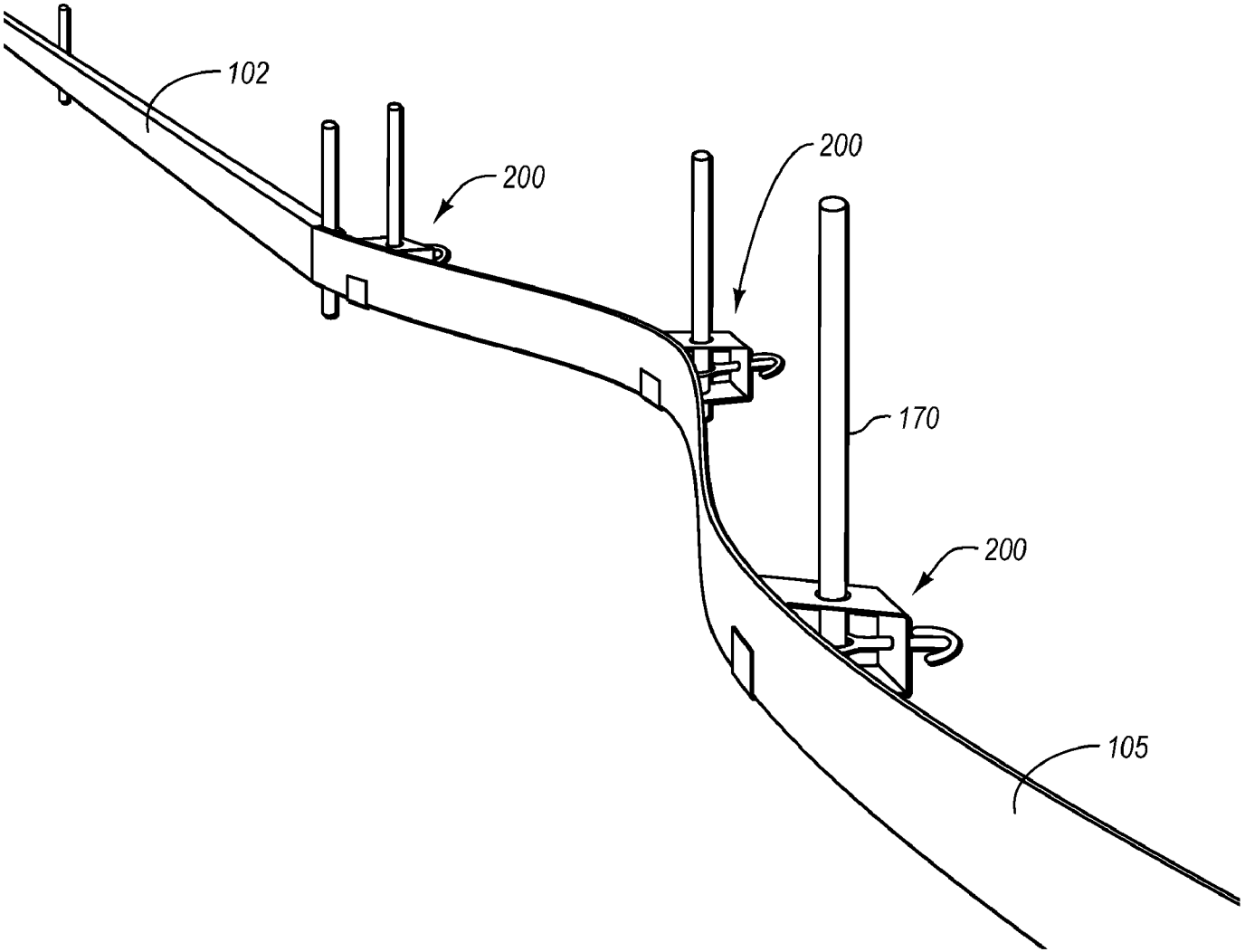
FIG. 7 is a perspective view of an embodiment of a grade bracket being employed along bending portions of a form in a concrete forming system.
Figure 8:
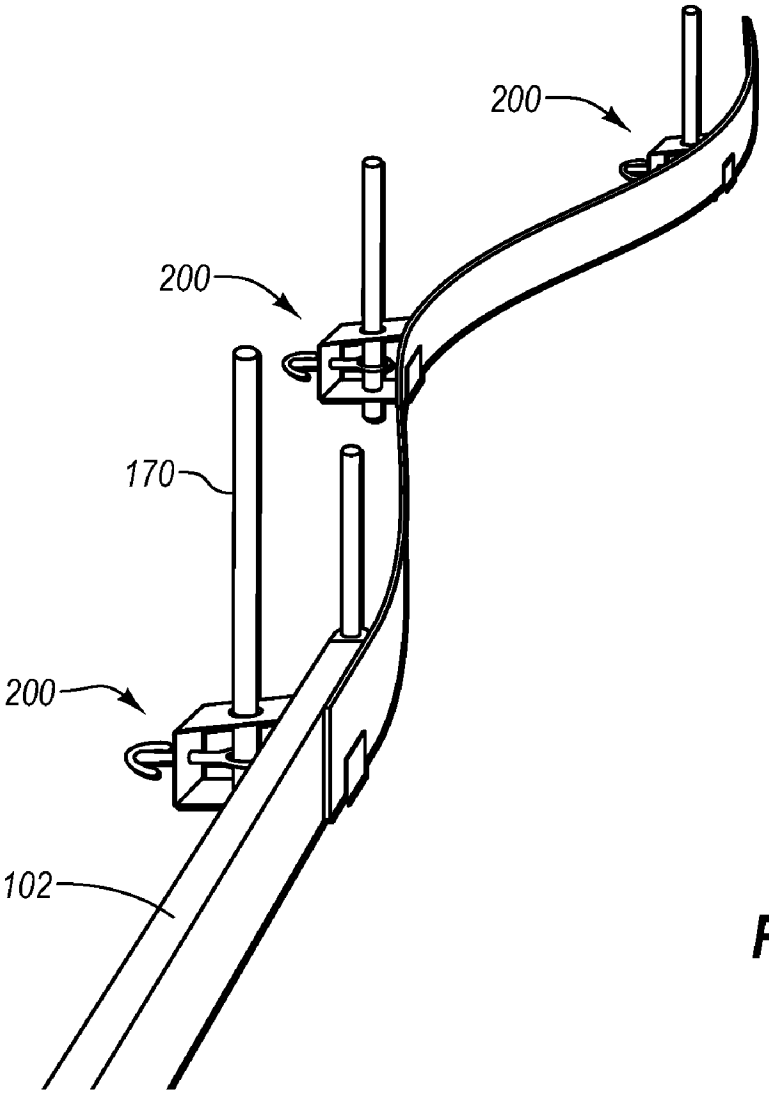
FIG. 8 is another perspective view of an embodiment of a grade bracket being employed along bending portions of a form in a concrete forming system.

FIGS. 7 and 8 depict multiple grade brackets 200 supporting various form components, including straight forms 102 and radius forms 105. Note that the grade bracket 200 can be used to support at grade form components having a variety of shaped configurations, such as those shown in FIGS. 7 and 8. Indeed, the grade brackets 200 can be used not only to maintain the form component at vertical grade, but can also maintain its lateral position, as is the case with the grade brackets 200 shown in FIG. 7 supporting the multi-curve radius form 105. So supported, the radius form 105 keeps its intended shape as a portion of the overall form system 100. Note that multiple grade brackets 200 can be employed to support one form, as shown in FIGS. 7 and 8, or multiple forms as in FIG. 6, according to need. Also, the spacing of multiple grade brackets 200 can vary according to need, weight of the form component to be supported, etc.

Figure 9:
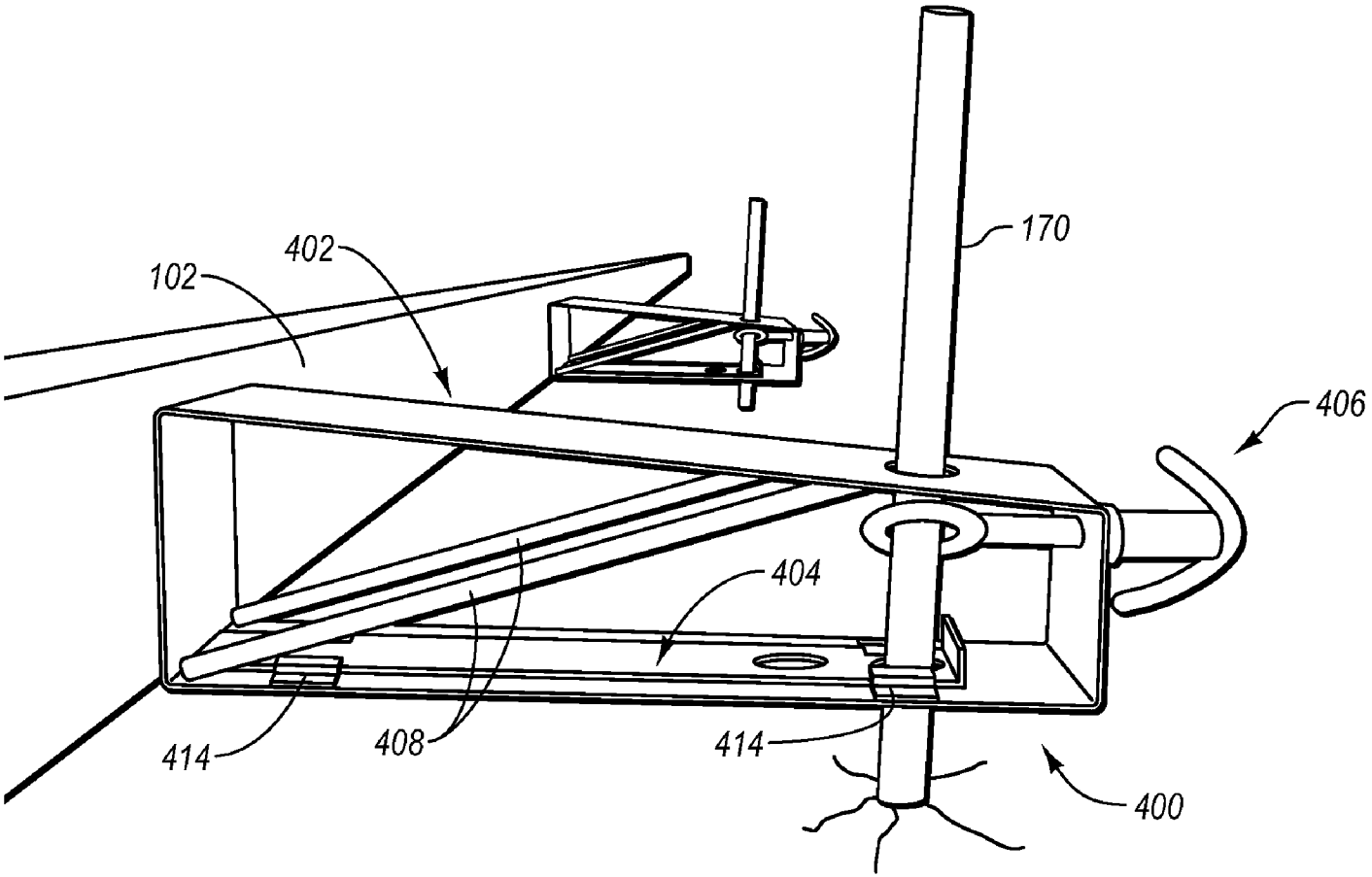
FIG. 9 is a perspective view of a grade bracket configured in accordance with another embodiment of the present invention.
Figure 10:
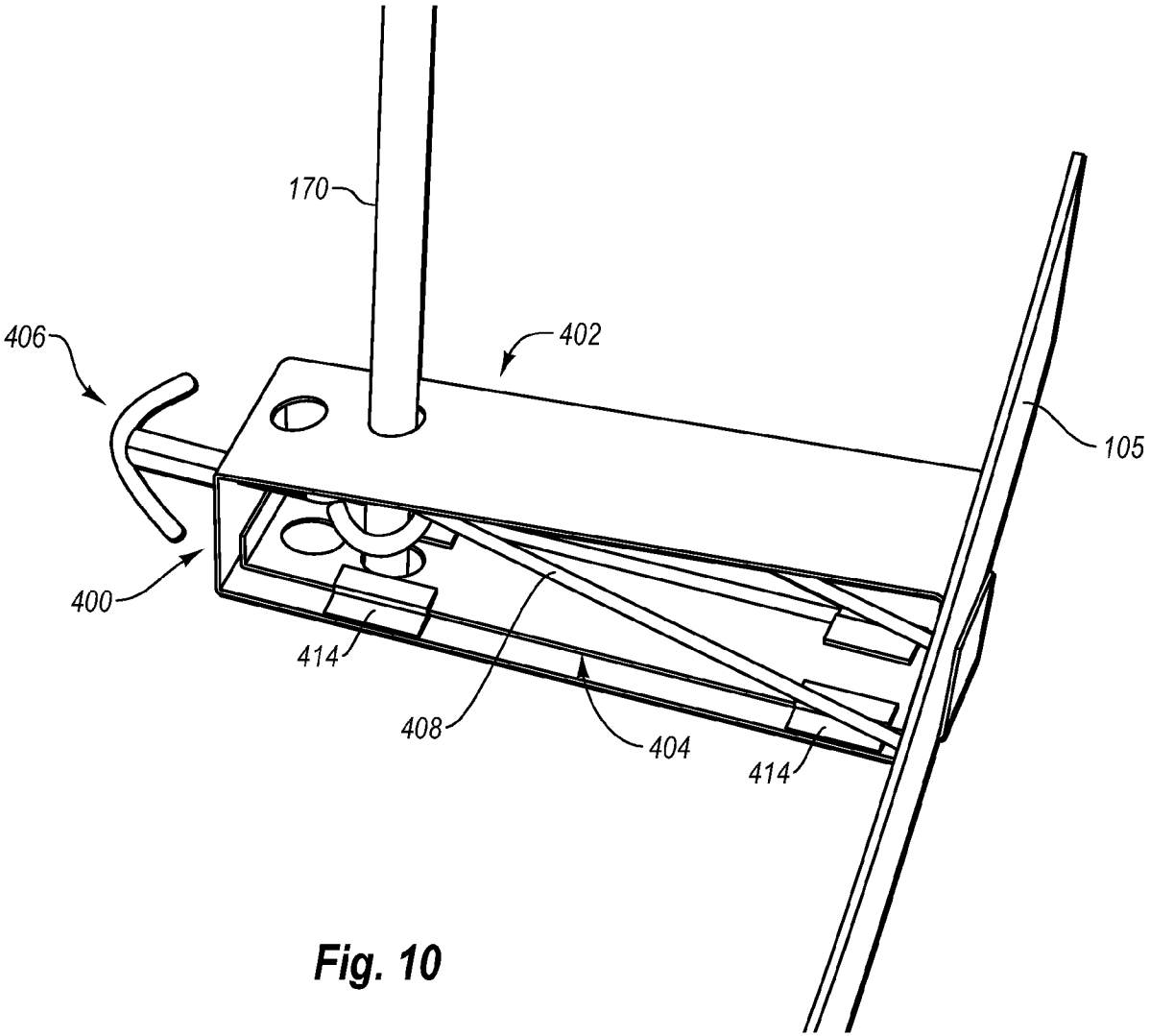
FIG. 10 is a perspective view of another implementation of the grade bracket of FIG. 9.

FIGS. 9 and 10 show a grade bracket, generally depicted at 400, that is configured according to another embodiment of the present invention. The grade bracket 400 includes many components similar to the grade bracket 200 of the previous embodiment, however with different proportions. For example, grade bracket may include four tabs 414, similar to tabs 214 in FIGS. 3 and 4, that are sized and configured to slidably engage with the form support member 404. In detail, a body 402 of the grade bracket 400 is elongated from that of the previous embodiment. This can be useful where the stake 170 cannot be placed sufficiently close to the form 102, 105 or panel 106 to be supported. As before, the grade bracket 400 also includes a form support member 404 and grade knob 406, with their accompanying components.

To compensate for any reduced rigidity the elongated body 402 might cause, the grade bracket 400 includes cross braces 408 to strengthen the body 402 such that a form component, such as the straight form 102, is supported at grade without excessive bending of the grade bracket 400. Note that, though the grade brackets 400 shown in the accompanying drawings are made of metal, such as steel, other materials, including plastic and polymer compositions can also employed to form the grade brackets 400. As such, the cross braces 408 may be more or less needed, depending on the overall dimensions of the grade bracket 400 and the material from which it is composed.

Use of the grade bracket 400 is substantially the same as that described in connection with the previous embodiment. Note that other dimensions of the grade bracket 400 can be altered in size in order to accommodate a particular need or application. Thus, the embodiment of the present grade bracket 400 shown in FIGS. 9 and 10 is merely exemplary of the broader principles encompassed by the present invention, and other such modifications thereto are therefore contemplated as a part of this invention.

The present invention may be embodied in other specific forms without departing from its spirit or essential characteristics. The described embodiments are to be considered in all respects only as illustrative, not restrictive. The scope of the invention is, therefore, indicated by the appended claims rather than by the foregoing description. All changes that come within the meaning and range of equivalency of the claims are to be embraced within their scope.

What is claimed is:

1. A grade bracket for supporting a form component of a concrete form system, the grade bracket comprising:

a body defining a top surface, a bottom surface, a first side surface, and a second side surface, wherein at least one hole is defined in each of the top and bottom surfaces;

a form support member including a bracket portion configured to engage the form component, the body including two tabs that slidably retain the form support member with respect to the body such that the bracket portion is selectively movable with respect to the body, the form support member further including a hole defined therein; and a grade knob threadably engaged with the body, the grade knob including:

a handle; and an eye-bolt that is selectively alignable with the holes of the bracket portion and top and bottom body surfaces such that a stake can pass through the eye-bolt and the holes of the bracket portion and top and bottom surfaces, wherein the grade knob is configured to selectively engage the stake such that the grade bracket is maintained at a desired position with respect to the stake and such that the form component is maintained at a desired grade.

2. The grade bracket as defined in claim 1, wherein the form support member further includes a slide portion that is slidably retained by the tabs on the bottom surface of the body, the slide portion being attached to the bracket portion, the bracket portion extending through a slit defined in the second side surface.

3. The grade bracket as defined in claim 2, wherein the bracket portion includes an "L"-shaped portion that cooperates with the second side surface of the body to support the form component.

4. The grade bracket as defined in claim 3, wherein the eye-bolt of the grade knob is round and frictionally engages the stake such that the grade bracket maintains the form component at a predetermined grade and lateral position and such that the form support member is secured in place.

5. The grade bracket as defined in claim 4, wherein multiple holes are defined in the slide portion of the form support member, each of the multiple holes being alignable with the holes defined in the top and bottom surfaces of the body so as to receive the stake and extend the bracket portion a predetermined amount from the second side surface.

6. The grade bracket as defined in claim 5, wherein the form component supported by the grade bracket is one of the following: a straight form, a radius form, and a skin panel.

7. The grade bracket as defined in claim 6, wherein the body defines a hollow trapezoidal shape.

8. The grade bracket as defined in claim 7, further comprising at least one cross brace extending between surfaces of the body.

* * * * *